United States Patent [19]

Garcia

[11] 3,958,090

[45] May 18, 1976

[54] MINIATURE SWITCH ASSEMBLY

[75] Inventor: Ricardo L. Garcia, Justice, Ill.

[73] Assignee: Grayhill, Inc., LaGrange, Ill.

[22] Filed: Dec. 18, 1974

[21] Appl. No.: 533,882

[52] U.S. Cl. ..... 200/67 AA; 200/5 A; 200/277

[51] Int. Cl.[2] ..... H01H 13/28

[58] Field of Search..... 200/5 A, 67 AA, 67 A, 200/277, 339, DIG. 54

[56] References Cited

UNITED STATES PATENTS

| | | | |
|---|---|---|---|
| 1,882,857 | 10/1932 | Meuer | 200/67 AA |
| 2,927,185 | 3/1960 | Bonnaire | 200/67 AA |
| 3,227,820 | 1/1966 | Sorenson | 200/5 A |
| 3,684,847 | 8/1972 | Hoehn et al. | 200/67 A |

*Primary Examiner*—Herman J. Hohauser
*Attorney, Agent, or Firm*—Lockwood, Dewey, Zickert & Alex

[57] ABSTRACT

A miniature switch assembly includes a switch housing having a cover and end plate and includes a plurality of switch operating rocker arms extending outwardly from the switch cover. Each of the operating rocker arms is rotatably movable between a first closed position and a second open position and includes a spring mounted in the base which biases a ball contactor thereon to selectively bridge a pair of conductor terminals mounted within the housing to complete the switch action. Each pair of the conductor terminals is secured to the end plate which in turn is secured to the switch cover to hold the switch assembly in assembled relationship.

10 Claims, 7 Drawing Figures

FIG. 1
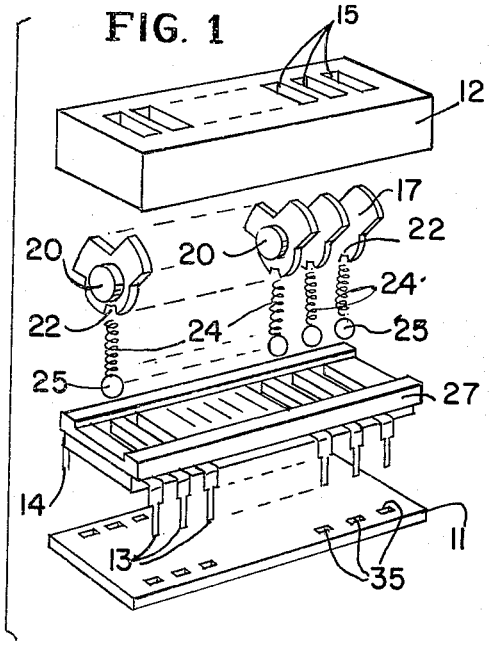
FIG. 2
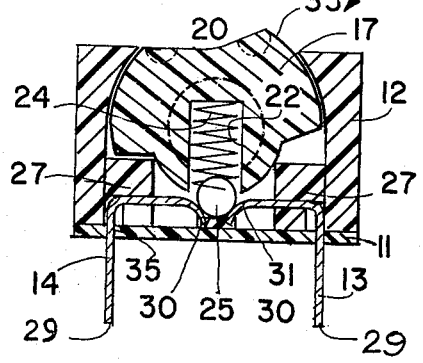
FIG. 3
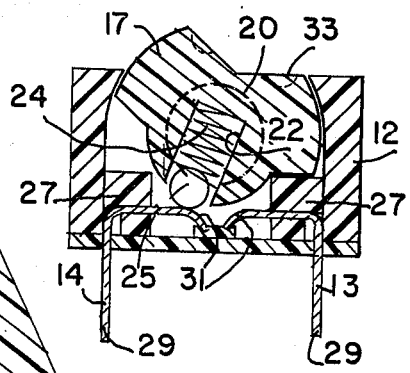
FIG. 5
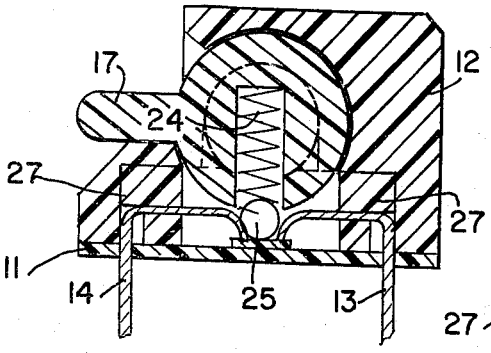
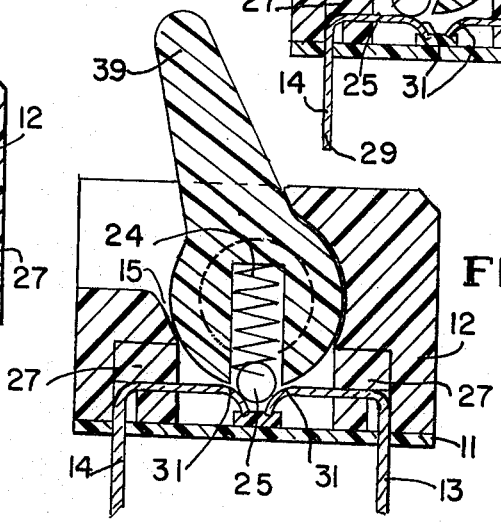
FIG 6
FIG. 7
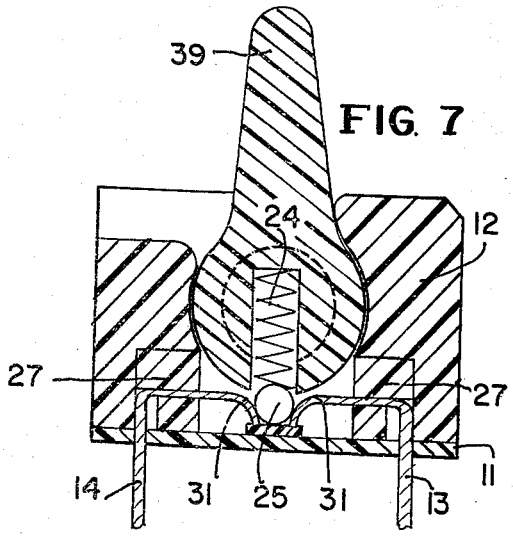
FIG. 4
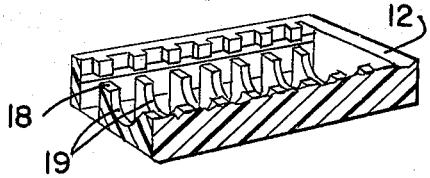

MINIATURE SWITCH ASSEMBLY

BACKGROUND OF THE INVENTION

This invention relates to switch assemblies and more particularly, to miniature electrical switch assemblies wherein a plurality of switching mechanisms enclosed within a switch housing are actuated by a plurality of switch operating rocker arms which extend outwardly from the switch housing. The miniature switch assemblies have utility in printed circuit boards.

In the past, various arrangements have been suggested for the design of miniature electrical switch assemblies and attempts have been made to design miniature switch assemblies having a switching action which provides a positive control and tease proof reliability. Many of these arrangements include a switch assembly wherein the switch operating member functions to bend one terminal of the switch assembly onto the other terminal of the switch assembly to complete the switch action. Of necessity, the conductor terminals must be very fragile to withstand such a deformation to provide the switch action. Understandably, such switch assemblies have a lifespan of only about 5000 mechanical operations, a performance standard which is unacceptable in many printed circuit board applications.

SUMMARY OF THE INVENTION

It is one object of this invention to provide an improved electrical switch assembly.

It is another object of this invention to provide an economical electric switch assembly which permits precise cooperation between a rotary mounted ball contactor and a pair of terminal conductors.

It is still a further object of this invention to provide a miniaturized switch assembly which provides positive contact and tease proof reliability for controlling the switch mechanism.

In one embodiment of this invention the switch housing includes a cover portion having a first open side and the side opposite the open side having a plurality of slots therein. The slots are each adapted to receive and hold the switch operating rocker arm of the present invention. The switch operating rocker arm includes a pair of shoulders molded integrally thereon which shoulders permit the operating rocker arm to pivot about recesses positioned adjacent each of said slots within the switch housing cover. The rocker arm includes a recess in the base thereof which recess is adapted to receive a spring which is engageable with a ball contactor. The spring biases the ball contactor downwardly to complete the switch action between a pair of conductor terminals mounted adjacent one another and extending outwardly from an insulating end plate or base of the switch housing. When the switch assembly is in assembled relationship, the resiliently mounted ball contactor bridges the conducting terminals to provide the closed position wherein the switch action is completed. When the operating rocker arm is rotatably moved, the ball contactor overcomes the detent shoulder on a selected one of the conductor terminals and is pivotally moved away from contacting both of the conducting terminals to provide a second or open position. The spring loaded sliding ball contact insures that the switch action is either in the open or closed position and provides a positive wiping action and tease proof reliability in the switching mechanism.

The miniaturized switch assembly may be so constructed to provide any number of independent switch mechanisms within the switch assembly.

BRIEF DESCRIPTION OF THE DRAWINGS

FIG. 1 is an exploded view showing the housing cover portion, spring loaded sliding ball contact and operating rocker assembly, the conducting terminals and the insulating end plate in accordance with one embodiment of this invention;

FIG. 2 is a side elevation view in cross section of the switch assembly in the closed position in accordance with one embodiment of this invention;

FIG. 3 is a side elevation view in cross section of the switch assembly in the open position in accordance with one embodiment of this invention;

FIG. 4 is a fragmentary perspective view of the cover portion showing the recesses in the cover portion for receiving actuators in accordance with one embodiment of the present invention;

FIG. 5 is a side elevation view in cross section of a switch assembly in accordance with a further embodiment of the present invention;

FIG. 6 is a side elevation view in cross section of the switch assembly in accordance with another embodiment of the present invention; and FIG. 7 is a side elevation view in cross section of a further embodiment of the switch assembly in accordance with the present invention.

DETAILED DESCRIPTION

Referring now to the drawings, in FIGS. 1–4 the switch assembly of the present invention is shown as including a switch housing 10 having a base or end plate portion 11 and a cover portion 12. The switch housing 10 forms a hollow cavity therein for enclosing any number of switching mechanisms, as will hereinafter be described. The switch cover 12 is provided with a plurality of apertures or slots 15 therein which are adapted to receive the switch operating rocker arms or actuating members 17 which are biased outwardly by the switch mechanism within the switch housing to permit external actuation of the switch mechanism.

The switch cover 12 of the switch housing 10 is provided also with a plurality of supports 18 (FIG. 4) extending across the width thereof, each of said supports having recesses 19 therein. Each of the supports straddle one of the slots or apertures 15 in the cover 12. The actuator in the form of an operating rocker arm 17 includes shoulder portions 20 extending perpendicularly outwardly therefrom, which shoulder portions are adapted to be received by recesses 19 within the cover 12 to provide an axis about which the operating rocker arm 17 may rotate between the open and closed position as desired.

The base of operating rocker arm 17 further includes a recess 22 therein which recess is adapted to receive a coiled spring 24. The coiled spring 24 is engageable with a ball contactor 25 to bias the same downwardly to engage the conductor terminals 13 and 14, as will hereinafter be described.

Each of the conductor terminals 13 and 14 is mounted to a frame member 27 and includes terminal end portions or legs 29 extending downwardly therefrom and conducting end portions or arms 30 bent away from the axis of rotation of the ball contactor within frame member 27 to form shoulder portions 31 to provide a well between each of the adjacently mounted conductor terminals 13 and 14. The insulating base or end plate 11 includes a plurality of openings 35 therein which are adapted to receive the terminal ends 29 of the conducting terminals 13 and 14 such that when the switch elements are assembled in operating relationship, the terminal ends 29 extend outwardly through openings in the base or end plate 11, as shown in FIG. 2.

To assemble the switch assembly, the shoulder portions 20 of the operating rocker arms 17 are positioned in recesses 19 of supports 18 of the cover 12 such that the rocker arms extend outwardly through slots 15 in the cover 12. The coil spring 24 having the ball contactor 25 thereon is inserted into the recesses 22 of the operating lever 17 and the frame member 27 holding the conducting terminals 13 and 14 is inserted within the cover 12. Lastly, the insulated end plate 11 is positioned such that the terminal ends 29 extend through slots 35 in the end plate 11 to provide a compact and miniaturized switch assembly. The insulating end plate 11 is sonically sealed to the cover 12 to provide an effective seal against flux and flux cleaners from penetrating the switch housing 10.

FIG. 2 shows the switch assembly in the first or closed position wherein the spring loaded sliding ball contactor 25 is bridging the conducting ends 30 of the conducting terminals 13 and 14, respectively. When it is desired to open the switch of the present invention, a downward movement of the top edge 33 of the operating rocker arm 17 results in a pivotal or rotating movement of the operating rocker arm 17 in a clockwise direction. Such movement causes the ball contactor 25 to pass upwardly over the shoulder portion 31 of conducting terminal 14. A detent action occurs until the resistance of the shoulder portion 31 contacting the ball contactor 25 is overcome and the switch operating plunger will snap into the open position, as shown in FIG. 3, wherein ball contactor 25 is biased against frame member 27. By providing that the conducting end portions 30 of the conductor terminals 13 and 14 have shoulder portions 31 thereon which are recessed downwardly, a well is provided between the terminals 13 and 14 which permits a positive contact with a wiping action between the ball contactor 25 and the conducting ends 30 of conducting terminals 13 and 14. Such a wiping action provides a tease proof contact between the ball contactor and the conducting terminal and insures that the switch mechanism is either in the open or closed position and cannot be located in some intermediate position which could produce an intermittent electrical contact between the two conductor terminals.

Preferably, the ball contactor 25 is a gold plated nickel material and the conductor end portions 30 of the conductor terminals 13 and 14 are a gold plated brass alloy. Additionally, the base 11 and cover 12 are composed of an insulating thermoplastic material which may be sealed together to provide a sealed switch assembly, as set forth above.

FIGS. 5, 6 and 7 describe further embodiments of the present invention wherein in FIG. 5 the actuator 17 in the form of a toggle extends perpendicularly outwardly through a slot 15 in the switch housing cover 12 with respect to the contact between the ball contactor 25 and the conductor terminals 13 and 14. The internal switch mechanism of this embodiment is the same as set forth above. Such a structure provides an application for the electrical switch of the present invention wherein the switch actuation of the operating rocker arm 17 may be utilized where space and other requirements prohibit the use of a top actuated electrical switch mechanism.

In FIGS. 6 and 7, the toggle 17 includes an extended end portion 39 thereon which extends outwardly therefrom from an opening 15 in the corner or top of the switch cover 12, respectively. Again the operation of the internal switch mechanism of this embodiment of the present invention is identical to that disclosed above with respect to FIGS. 1–4. Such a design permits easier access and leverage in initiating the switching mechanism of the present invention.

The design and structure of the positioning of the conducting terminals 13 and 14 with respect to the ball contactor 25 arrangement of the operating rocker arm 17 provides a switching mechanism which is capable of in excess of 50,000 mechanical operations, more than 10 times the number of mechanical operations which can be achieved by any of the presently commercially available switch mechanisms. Moreover, the unique method of sealing the end plate or base 11 to the cover 12 during the assembly of the elements which comprise the electrical switch assembly provides a switch assembly which is free from flux and flux cleaners which are utilized in applications wherein the switch assembly of the present invention is dip soldered or machine soldered to a printed circuit board.

As can be clearly understood from the above discussion, the switch assembly of the present invention provides that the only moving part of the switch assembly is the operating rocker arm or actuator 17 containing the coil spring 24 and the ball contactor 25. Because the conductor terminals 13 and 14 are fixedly mounted within the switch housing 10, the contact between the conductor terminals and the ball contactor is under a controlled pressure as established by the coil spring 24 and the ball contactor 25. Additionally, the instant switching assembly provides that a number of miniature switching units may be combined within the switch housing to offer multiple switching operations for the particular purpose desired.

What has been described, therefore, is a miniature switch assembly wherein any number of switch units may be combined within a single switch housing and wherein the electric contact between the ball contactor and conducting terminals is under a controlled pressure established by the coiled spring biasing the ball contactor in contact with the conductor terminals.

It is claimed:

1. A miniature electrical switch comprising a housing of electrical insulating material, said housing including a cover portion and a base portion, said cover portion being generally rectangular in shape and having a top wall, opposed side and end walls and being open opposite the top wall, said base portion being rectangular in form and of substantially the same rectangular form as the cover portion, switching and terminal means mountable within the housing and including a frame member of electrical insulating material supporting a plurality of juxtaposed sets of conductor terminals, each set of conductor terminals including a pair of axially aligned terminal arms having spaced apart contact portions defining an open area therebetween and terminal legs integral with said arms and extending at right angles to said arms, said switching and terminal means further including a plurality of actuators of electrical insulating material and a plurality of ball contactors of electrical conducting material, openings in the cover portion for a portion of the actuators to extend therethrough to be engaged during operation of the switch, each actuator having shoulder means for permitting pivotal mounting thereof within the housing, bearing means integrally formed in the cover portion for coacting with the shoulder means of each actuator, a blind hole in each actuator facing the contact portions of the terminals and freely receiving a ball contactor, resilient means in the blind hole for resiliently urging each ball contactor outwardly of the blind hole and into engagement with one or both of the contact portions of the terminal arms, whereby each said actuator is movable between first and second positions and in one position disposes the ball contactor into engagement with both contact portions of the terminal arms to close the switch and in the other position disposes the ball contactor into engagement with only one terminal arm of each set to open the switch.

2. A miniature electrical switch as defined in claim 1, wherein openings are provided in the base portion through which the terminal legs extend.

3. A miniature electrical switch as defined in claim 1, wherein one of said terminal arms includes means for coacting with the ball contactor to positively cause positioning of the actuator in either said first or second position.

4. A miniature electrical switch as defined in claim 1, wherein each actuator is in the form of a rocker member.

5. A miniature electrical switch as defined in claim 4, wherein the openings in the cover portion are in the top wall thereof.

6. A miniature electrical switch as defined in claim 1, wherein each actuator is in the form of a toggle member.

7. A miniature electrical switch as defined in claim 1, wherein each actuator is in the form of a toggle member and the openings in the cover portion are formed in the top wall thereof.

8. A miniature electrical switch as defined in claim 1, wherein each actuator is in the form of a toggle member and the openings in the cover portion are formed in one of the side walls of the cover.

9. A miniature electrical switch as defined in claim 1, wherein said frame member is telescopically received within the cover portion, and said switch further includes means fastening the base portion to the cover portion to retain the frame member and the actuators within the cover portion and close the cover portion.

10. A miniature electrical switch as defined in claim 1, wherein said frame member includes separating insulating bars between each set of terminal conductors.

* * * * *